US010001103B1

(12) United States Patent
Kirk

(10) Patent No.: US 10,001,103 B1
(45) Date of Patent: Jun. 19, 2018

(54) SYSTEM WITH MULTIPLE STARTERS AND SMART RELAY

(71) Applicant: BorgWarner Inc., Auburn Hills, MI (US)

(72) Inventor: Michael E. Kirk, Greenfield, IN (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days. days.

(21) Appl. No.: 15/380,427

(22) Filed: Dec. 15, 2016

(51) Int. Cl.
*F02N 11/00* (2006.01)
*F02N 11/08* (2006.01)
*F02N 15/02* (2006.01)

(52) U.S. Cl.
CPC ..... *F02N 11/006* (2013.01); *F02N 11/087* (2013.01); *F02N 11/0848* (2013.01); *F02N 15/02* (2013.01)

(58) Field of Classification Search
CPC .. F02N 11/006; F02N 11/0848; F02N 11/087; F02N 15/02; F02N 11/08
See application file for complete search history.

(56) References Cited

U.S. PATENT DOCUMENTS 3,653,699 A * 4/1972 Podesta ..... F02D 27/02 290/37 R
4,013,056 A * 3/1977 Yamaki ..... F02D 41/062 123/179.5
5,967,106 A * 10/1999 Schulze ..... F02N 11/0851 123/179.3
6,176,212 B1 * 1/2001 Vilou ..... F02N 11/08 123/179.3
6,737,759 B2 * 5/2004 Osada ..... F02N 11/087 307/10.6
8,872,373 B2 * 10/2014 Rentschler ..... F02N 11/087 290/38 R
9,133,810 B2 * 9/2015 Kees ..... F02N 11/006
2005/0083631 A1 * 4/2005 Ouvry ..... F02N 11/087 361/139
2005/0275988 A1 * 12/2005 Hunninghaus ..... F02N 11/087 361/92
2010/0018489 A1 * 1/2010 Ikushima ..... F02N 11/0862 123/179.3
2013/0167790 A1 * 7/2013 Bradfield ..... F02N 11/006 123/179.25
2017/0268474 A1 * 9/2017 Kirk ..... F02N 11/087

* cited by examiner

*Primary Examiner* — Thomas Moulis
(74) *Attorney, Agent, or Firm* — Bose McKinney & Evans LLP

(57) ABSTRACT

The present disclosure teaches a system for starting an engine in which at least two starter assemblies are employed to crank a ring gear of an engine. At least one of the starter assemblies has a "smart relay" configured with an auto-retry function that detects abutment and corrects it by powering the solenoid off and then on again. Advantageously, multiple starter assemblies can be in electrical communication with one another so that click-no-crank events in the starter assemblies can be corrected.

14 Claims, 4 Drawing Sheets

SYSTEM WITH MULTIPLE STARTERS AND SMART RELAY

BACKGROUND

This application relates to the field of starter motor assemblies, and more particularly, to starter motor assemblies including two or more starter motors.

Starter motor assemblies are used to start vehicle engines, such as engines in heavy duty vehicles. The conventional starter motor assembly includes an electric motor, a solenoid, and a drive mechanism.

The starter motor is placed in operation when a user closes an ignition switch on the vehicle and energizes the solenoid. Energization of the solenoid moves a solenoid shaft (also referred to herein as the "plunger") in an axial direction. Movement of the solenoid plunger closes electrical contacts, thereby delivering full power to the electric motor. Movement of the solenoid plunger also moves a pinion of the drive mechanism into engagement with the engine flywheel gear. The electric motor delivers torque to the pinion. The pinion, in turn, causes the flywheel to rotate, thereby cranking the vehicle engine.

Once the vehicle engine starts, the operator of the vehicle opens the ignition switch, de-energizing the solenoid assembly. As a result of this deenergization, the magnetic field that caused the plunger to move decreases and is overcome by a return spring, causing the plunger to return to its original position. As the plunger moves to its original position, the pinion is pulled away from the ring gear, and the vehicle engine operates free of the starter motor.

It is well-known by those having ordinary skill in the art that conventional starter systems have been susceptible to a problematic failure mode known in the art as "click-no-crank." Click-no-crank refers to the axial face of the starter assembly pinion being driven into abutment with the interfacing axial surface of the engine ring gear, rather than the teeth of the ring gear and pinion becoming enmeshed. Such incidences involve energization of the starter solenoid assembly during operator activation of the switch, which results in the pinion-ring gear abutment (typically resulting in an audible "click") blocking movement of solenoid switch contact plate, thereby preventing the switch from closing. Prolonged application of electrical power to solenoid assembly during an abutting condition between the pinion and ring gear can prevent the gears from meshing.

To address click-no-crank problems, some starter motors include a feature known as "soft-start." Soft-start arrangements generally allow some limited power to be provided to the electric motor before the pinion engages the ring gear. As a result, the electric motor and pinion provide a "soft start" torque which helps the pinion clear any abutment with the ring gear, thus encouraging the pinion teeth to fully mesh with the ring gear teeth. However, this "soft-start" feature just mentioned is sometimes insufficient to overcome a click-no-crank event.

One of the historical challenges of dual and triple starter applications of the type subject of this disclosure has been the reliable engagement of all starters, virtually simultaneously. Dual and triple starter systems are typically provided in large heavy-duty equipment. For example, large unmanned generators with engines as large as 150 liters commonly have three starter assemblies to crank the engine. The starting operation of such generators can be entirely automated, being automatically triggered at the start of a power failure. In these circumstances, a click-no-crank event can result in automated cranking of the starters for 30 or 60 seconds, or whatever time interval is programmed, during which time a very high current passes through the coils, which can ultimately burn up the coils and cause the starter assemblies to fail. Similar problems may occur in other large industrial equipment, such as bulldozers, large trucks and other heavy duty equipment.

It would be desirable to achieve a cost-effective means for ensuring reliable and simultaneous engagement of all starters in a system using two or more starters that crank a single engine.

SUMMARY

The present disclosure teaches a system for starting an engine in which at least two starter assemblies are employed to crank a ring gear of an engine. At least one of the starter assemblies has a "smart relay" configured with an auto-retry function that detects abutment and corrects it by powering the solenoid off and then on again. Advantageously, multiple starter assemblies can be in electrical communication with one another so that a click-no-crank event in one or more of the starter assemblies can be corrected.

In one form thereof, the present disclosure teaches a system for starting an engine. The system includes a first starter assembly and a second starter assembly operable with the first starter assembly to crank an engine. Optionally, additional starter assemblies may be included. A smart relay is operably connected to the first starter assembly and has an auto-retry function. During a starting operation, if a sensed voltage monitored by the smart relay falls below a threshold level within a predetermined time after application of electrical power to a solenoid of the first starter assembly, the smart relay activates the auto-retry function to switch electrical power to the solenoid off and on, whereby a click-no-crank event can be corrected.

In some embodiments, the M sense terminal of the smart relay is electrically connected to the second starter. As such, engagement of the second starter assembly with the engine disables the auto-retry function of the smart relay. In other embodiments, engagement of the first or second starter assembly with the engine disables the auto-retry function of the smart relay.

The second starter assembly may optionally comprise a second smart relay which has the same auto-retry functionality as the first smart relay. In such a system with two smart relays, the first smart relay and the second smart relay typically have interconnected M-terminal voltage sense leads. In this system, engagement of either one of the first and second starter assemblies with the engine disables the auto-retry function of both the first and second smart relays.

In a further embodiment, the system includes a third starter assembly operable with the first and second starter assemblies to crank the engine. The third starter assembly has a third smart relay that has the auto-retry function. In this system with three starter assemblies, engagement of any one of the first, second or third starter assemblies with the engine disables the auto-retry function of the first, second and third smart relays. The first, second and third smart relays typically have their M-terminal voltage sense leads interconnected to facilitate this feature.

In another embodiment having two starter assemblies, only one of the two starter assemblies has a smart relay, the other having a conventional relay switch. In such a system, engagement of the first or second starter assembly with the engine disables the auto-retry function of the smart relay. Failure of both the first and second starter assemblies to engage with the engine activates the auto-retry function of the smart relay. It is possible in accordance with this disclosure to have systems with more than two starters, e.g., a triple starter system, with only one of the starters having a smart relay that corrects an abutment condition of all three starters.

It has been found, surprisingly, that using a single smart relay in a system with multiple starters can overcome all click-no-crank events in the starter assemblies of such system. That is, in systems in accordance with these teachings, when all starter assemblies in the system abut at the beginning of a starting operation, the starter assembly having the smart relay activates its auto-retry function, which brings this starter into engagement with the ring gear. Then the other lagging starter assemblies will engage the rotating ring gear. Providing only one of the starter assemblies with a smart relay in a multiple starter system yields benefits in terms of cost savings and implementation.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
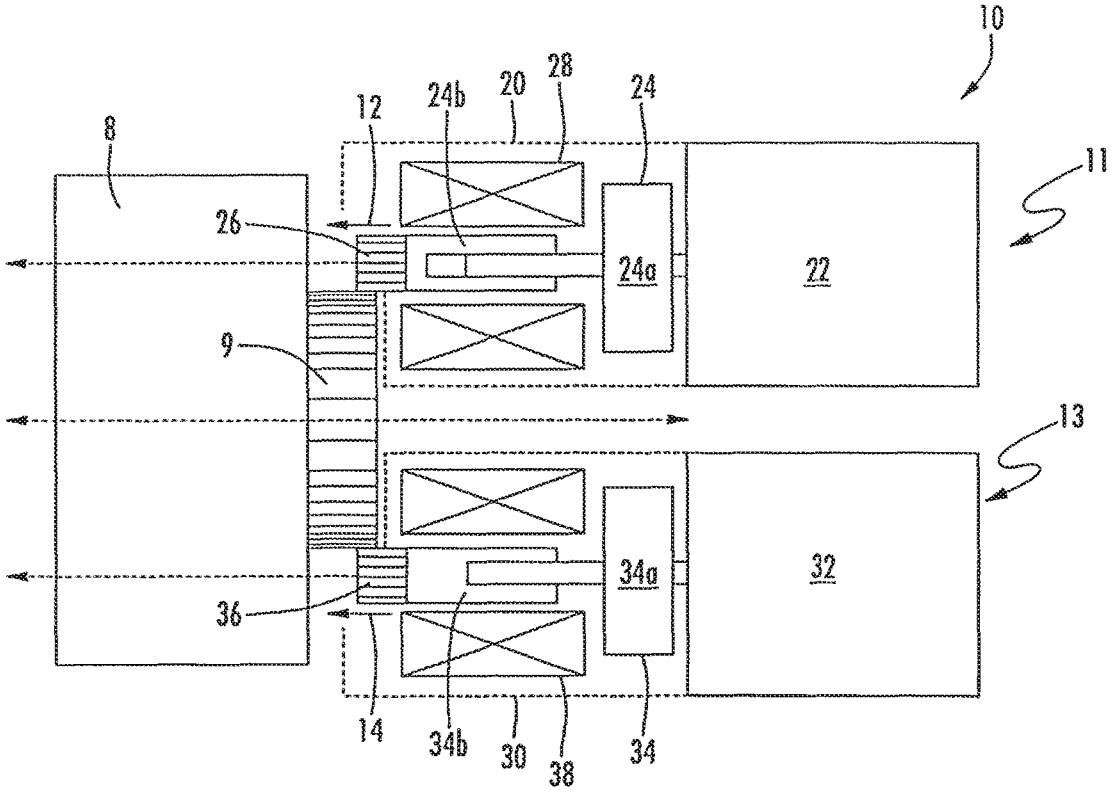
FIG. 1 is a diagrammatic view showing an engine equipped with first and second starter assemblies in accordance with this disclosure.

FIG. 1 illustrates a system 10 for starting an engine. The system 10 includes first starter assembly 11 and second starter assembly 13, which include, respectively, a first starter motor 20 and a second starter motor 30. The first starter motor 20 and second starter motor 30 are configured to engage a ring gear 9 of a vehicle engine 8, and crank the vehicle engine 8. The starter motors are electrically connected with a vehicle battery (not shown). The first starter motor 20 includes an electric motor 22, a drive mechanism 24, a pinion 26 and a solenoid assembly 28. The electric motor 22 is coupled to the drive mechanism 24 and is configured to transmit torque to the drive mechanism. The drive mechanism 24 includes a number of gears and related devices configured to transmit the torque from the electric motor 22 to the pinion 26. For example, the drive mechanism may include a planetary gear system 24*a* and a telescoping pinion shaft 24*b*, with the pinion 26 provided on the end of the pinion shaft 24*b*. The solenoid assembly 28 includes a spool with coils wound around the spool. The coils include a pull-in coil and a hold-in coil. The pinion shaft 24*b* extends through the spool and serves as the solenoid plunger. Accordingly, the solenoid assembly 28 disclosed in the embodiment of FIG. 1 is coaxial with the electric motor 22. However, it will be recognized by those of ordinary skill in the art that, in other embodiments, the starter motor 20 may be provided as a dual-axis starter motor where the solenoid assembly 28 is not coaxial with the electric motor 22 and is coupled to the drive mechanism 24 by a shift lever.

With further reference to FIG. 1, the second starter motor 30 is similar and can in some embodiments be identical to the first starter motor 20 and includes an electric motor 32, a drive mechanism 34, a pinion 36 and a solenoid assembly 38. The electric motor 32 is coupled to the drive mechanism 34 and is configured to transmit torque to the drive mechanism. The drive mechanism 34 includes a number of gears and related devices configured to transmit the torque from the electric motor 32 to the pinion 36. For example, the drive mechanism may include a planetary gear system 34*a* and a telescoping pinion shaft 34*b*, with the pinion 36 provided on the end of the pinion shaft 34*b*. The solenoid assembly 38 includes coils wound around a spool, including a hold-in coil and a pull-in coil. The coils that encircle the pinion shaft 34*b*, with the pinion shaft 34*b* serving as the plunger of the solenoid assembly 38. Accordingly, the solenoid assembly 38 disclosed in the embodiment of FIG. 1 is coaxial with the electric motor 32. Again, it will be recognized by those of ordinary skill in the art that the starter motor 30 may also be provided in other forms, such as a dual axis starter motor.

As indicated by arrow 12 in FIG. 1, when the solenoid assembly 28 of the first starter motor 20 is energized, the pinion shaft 24*b* and pinion 26 move in the axial direction toward the engine ring gear 9 of the vehicle engine 8. At the same time, the solenoid assembly 38 of the second starter motor 30 is energized, and the pinion shaft 34*b* and pinion 36 move in the axial direction toward the engine ring gear 9, as indicated by arrow 14. When the pinions 26 and 36 are moved into meshed engagement with the ring gear 9, the solenoid plunger is positioned to close electrical contacts which deliver full power to the electric motors 22 and 32. The electric motors 22, 32, deliver torque to the pinions 26, 36 via the drive mechanisms 24, 34. The pinions 22, 32, in turn, cause the flywheel to rotate, thereby cranking the vehicle engine. While only two starter assemblies 11 and 13 have been just described, it will become clear from the discussion below that more than two starters may be provided in systems in accordance with this disclosure.

Figure 2:
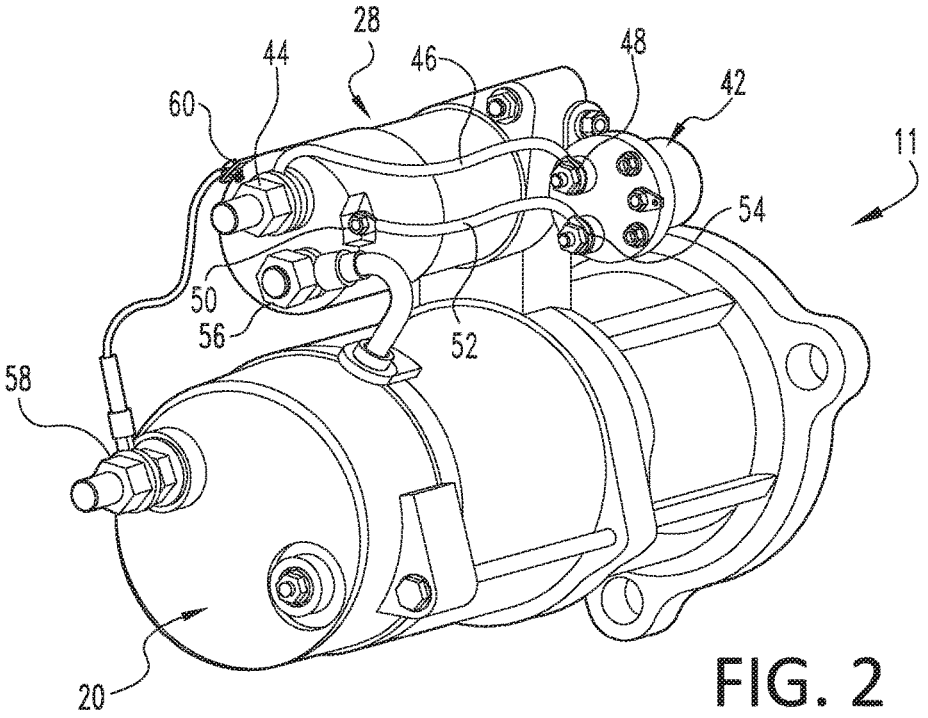
FIG. 2 is a perspective view of one of the starter assemblies of FIG. 1.

FIG. 2 shows a simplified perspective view of the exemplary starter system 11 of FIG. 1. As shown, solenoid assembly 28 has a B+ terminal 44 wired via wire 46 to terminal 48 of integral magnetic starter relay switch assembly (IMS) 42, whereas solenoid switch terminal 50 is wired via wire 52 to terminal 54 of IMS 42. The M terminal 56 of solenoid 28 is connected to motor 20, as is known in the art. Starter ground terminal 58 is connected to solenoid ground terminal 60 as shown. Further details and description of starter assembly 11 can be found in WO 2016/090185, titled Starter System Having Controlling Relay Switch, the entire disclosure of which is hereby incorporated herein by reference in its entirety. Reference is also made to WO 2016/090185 for further details of relay 42.

Figure 3:
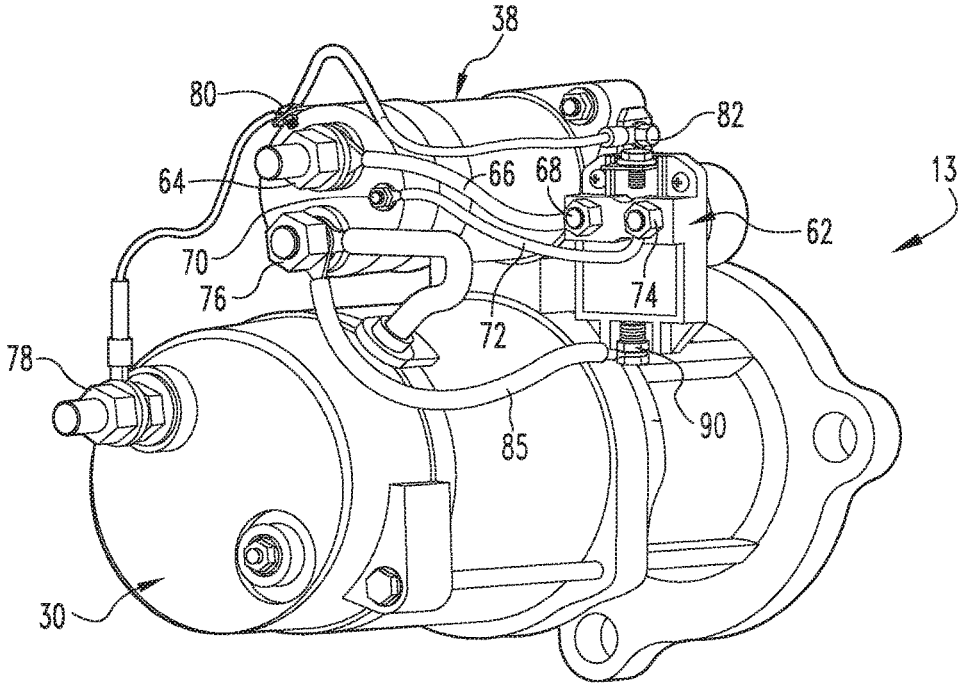
FIG. 3 is a perspective view of the other one of the starter assemblies of FIG. 1.

FIG. 3 shows a simplified perspective view of an exemplary starter system 13 of FIG. 1. As shown, solenoid assembly 38 has a B+ terminal 64 wired via wire 66 to terminal 68 of "smart" or "intelligent" integral magnetic starter relay switch assembly (iIMS) 62, hereinafter referred to as "smart relay" 62. Solenoid switch terminal 70 is wired via wire 72 to terminal 74 of smart relay 62. The M terminal 76 of solenoid 38 is connected to motor 30 and is also connected to M sense terminal 90 of smart relay 62 via wire 85. Starter ground terminal 78 is connected to solenoid ground terminal 80, which in turn is wired to bolt 82 of smart relay 62, which secures the smart relay to the solenoid and grounds the smart relay as shown. As one of skill in the art can readily appreciate, the difference between starter assembly 11 (FIG. 2) and starter assembly 13 (FIG. 3) is that the former includes a conventional IMS or relay 42 whereas the latter includes a smart relay 62.

A smart relay 62 suitable for practice with this disclosure is described in detail in WO 2016/090185 and reference for further details of the smart relay is made thereto. Essentially, smart relay 62 can be configured with several corrective functions, one of which is an "auto-retry" function to correct a "click-no-crank" problem, as described above. As described in detail in WO 2016/090185, smart relay 62 includes a controller that, during a starting operation, monitors motor energization voltage. If the voltage monitored falls below a predetermined threshold level within a predetermined time after the application of electrical power to the solenoid assembly 38, the controller of smart relay 62 opens and re-closes the switch to switch electrical power to the solenoid assembly 38 off and on. This functionality can correct a click-no-crank event during the starting operation.

For purposes of this disclosure, the term "smart relay" should be construed broadly, but in all events should be construed to include the "auto-retry" functionality described in the preceding paragraph and in more detail in WO 2016/090185. Of course, the smart relay may be configured with additional functionalities that are described in detail in WO 2016/090185.

Figure 4:
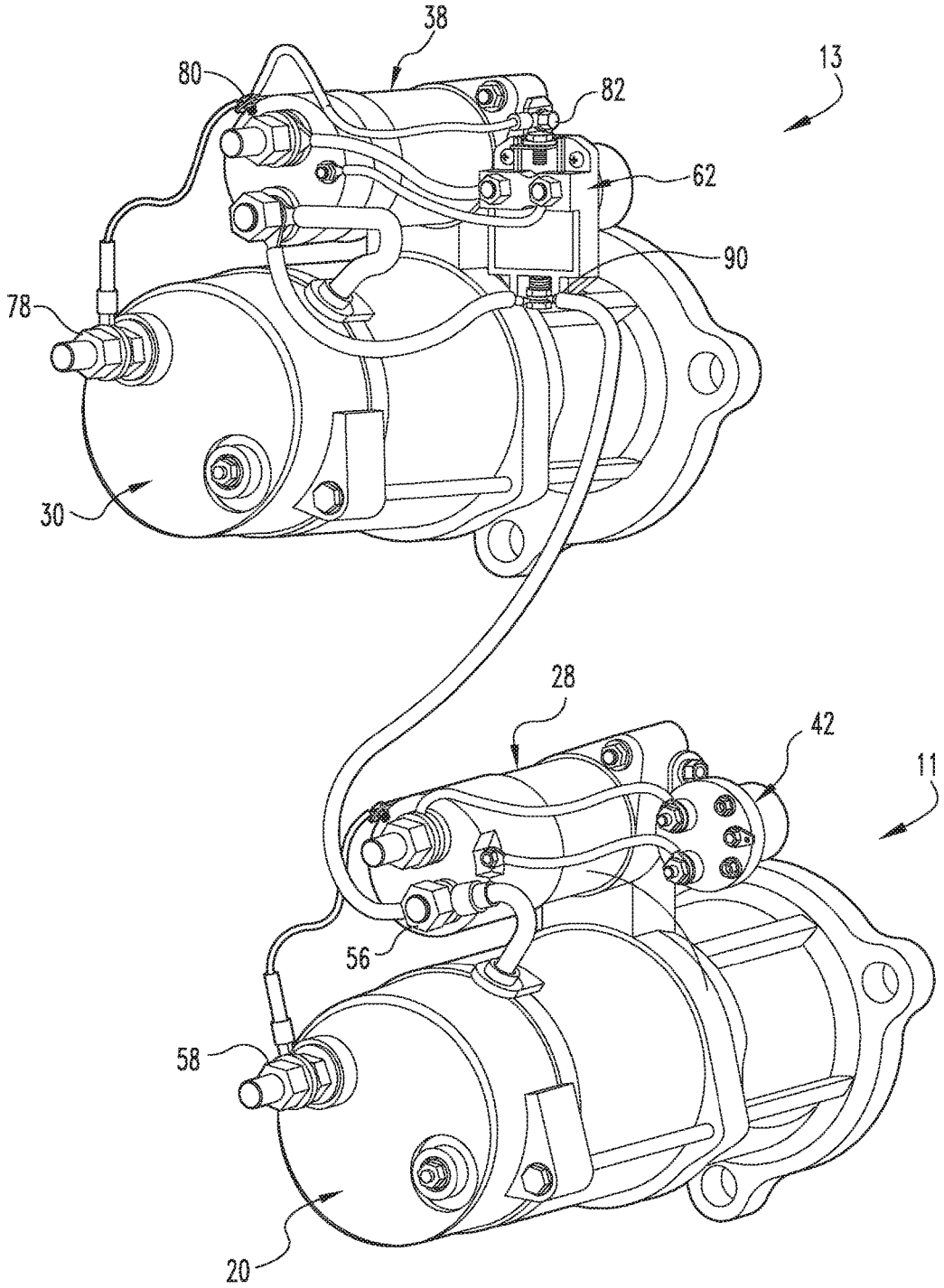
FIG. 4 is a perspective view illustrating two starter assemblies operable to crank an engine in accordance with this disclosure.

Turning now to FIG. 4, a system employing two starter assemblies 11 and 13 (as also shown in FIG. 1) is shown. The first starter assembly 11 and second starter assembly 13 are operable to crank the ring gear of an engine. As shown, starter assembly 13 includes a smart relay 62, which is equipped with the auto-retry function. As shown, M-terminal voltage sense lead 90 of smart relay 62 of starter assembly 13 is connected to M terminal 56 of starter assembly 11. As shown, starter assembly 11 has a conventional relay 42, whereas starter assembly 13 has a smart relay 62. As will be appreciated by one of ordinary skill, by virtue of the wiring shown in FIG. 4, smart relay 62 simultaneously senses the voltages in both M terminals 56 and 76.

With the system shown in FIG. 4, if the starter assemblies 11 and 13 both abut (click-no-crank), the auto-retry feature of smart relay 62 will activate, which in turn ensures that starter assembly 13 engages. Thereupon, the auto-retry feature of relay 62 is disabled. Starter assembly 11 is thus fully powered such that it will engage once the ring gear begins rotating. Similarly, if starter assembly 13 engages first, without the auto-retry function, and starter assembly 11 abuts, then starter assembly 11 will engage as soon as the ring gear begins rotation. If starter assembly 11 engages first and starter assembly 13 abuts, this will still be sensed by the smart relay 62. When this occurs, the auto-retry function is disabled, which then allows starter assembly 13 that is lagging in engagement to remain fully powered such that it will engage once the ring gear begins rotation.

Figure 5:
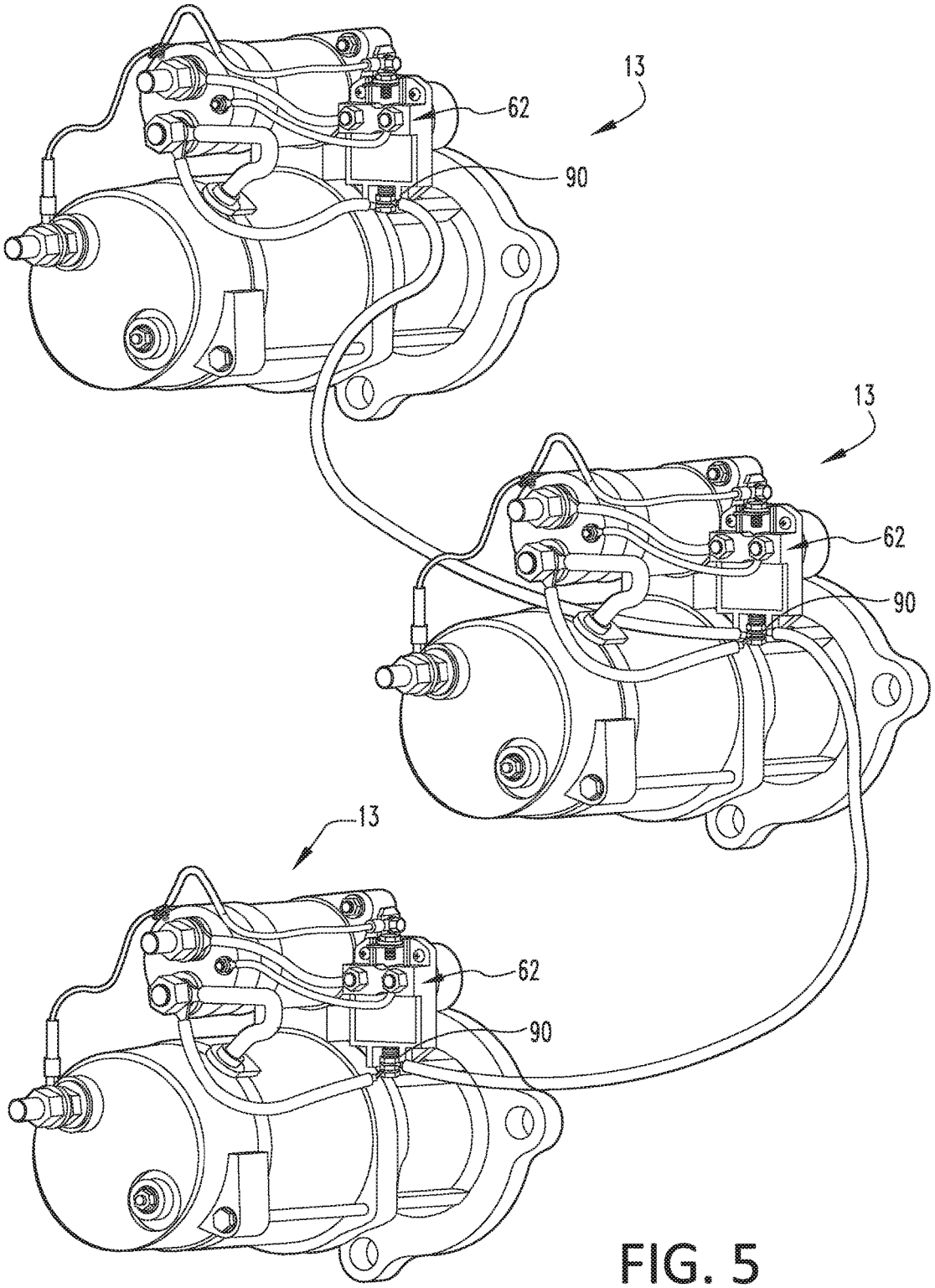
FIG. 5 is a perspective view illustrating three starter assemblies operable to crank an engine in accordance with this disclosure.

FIG. 5 shows a starter system having three identical starter assemblies 13 having their M-terminal voltage sense leads 90 interconnected as shown. When the solenoid contacts of any starter 13 in this system close, this event is sensed by all starters 13 in the system. When this occurs, the auto-retry function is disabled, which then allows the starters that are lagging in engagement to remain fully powered such that they will engage once the ring gear begins rotation.

In view of the exemplary embodiments discussed above, one of skill in the art could implement variations on starter systems with multiple starters. For example, a system having three starter assemblies with only one starter assembly having a smart relay could be configured. One of skill in the art will appreciate the advantages of such a system, such as cost savings from using only one versus multiple smart relays, the advantageous ease of implementation, and the simplicity of the configuration, i.e., fewer complicated parts. In this system, if all three starter assemblies abut (click-no-crank), then the auto retry function of the starter assembly with the smart relay will activate to clear the abutment. Then, when the ring gear begins to rotate, the other two lagging starter assemblies will be able to clear their abutments and engage the ring gear. On the other hand, if either of the two starter assemblies not having the smart relay engage first, then the auto-retry feature of the starter having the smart relay will become disabled, in which event the lagging starters will engage as the ring gear begins to rotate.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A system for starting an engine, comprising:

a first starter assembly;

a second starter assembly operable with the first starter assembly to crank an engine; and a first smart relay operably connected to the first starter assembly and having an auto-retry function, wherein during a starting operation, if a sensed voltage monitored by the first smart relay falls below a threshold level within a predetermined time after application of electrical power to a solenoid of the first starter assembly, the first smart relay switches electrical power to the solenoid off and on, whereby a click-no-crank event can be corrected.

2. The system of claim 1, wherein the first smart relay is electrically connected to the first and second starter assemblies.

3. The system of claim 2, wherein engagement of the second starter assembly with the engine disables the auto-retry function of the first smart relay.

4. The system of claim 2, wherein engagement of the first or second starter assembly with the engine disables the auto-retry function of the first smart relay.

5. The system of claim 2, wherein the second starter assembly comprises a second smart relay having the auto-retry function.

6. The system of claim 5, wherein the second smart relay is electrically connected to the first and second starter assemblies, wherein engagement of either one of the first and second starter assemblies with the engine disables the auto-retry function of the first and second smart relays.

7. The starter system of claim 6, wherein the first smart relay and the second smart relay have interconnected M-terminal voltage sense leads.

8. The starter system of claim 5, further comprising a third starter assembly operable with the first and second starter assemblies to crank the engine, the third starter assembly having a third smart relay having the auto-retry function.

9. The starter system of claim 8, wherein engagement of any one of the first, second or third starter assemblies with the engine disables the auto-retry function of the first, second and third smart relays.

10. The starter system of claim 8, wherein the first, second and third smart relays have interconnected M-terminal voltage sense leads.

11. The starter system of claim 2, wherein the second starter assembly has a conventional relay.

12. The starter system of claim 11, further comprising a third starter assembly having a conventional relay.

13. The starter system of claim 11, wherein engagement of the first or second starter assembly with the engine disables the auto-retry function of the first smart relay.

14. The starter system of claim 11, wherein failure of both the first and second starter assemblies to engage with the engine activates the auto-retry function of the first smart relay.

* * * * *